US008602639B2

(12) United States Patent
Zimmermann et al.

(10) Patent No.: US 8,602,639 B2
(45) Date of Patent: Dec. 10, 2013

(54) WINDING CROWN FOR A TIMEPIECE

(75) Inventors: Georges Zimmermann, Grenchen (CH); Pierre-Jean Bonnet, Courtelary (FR)

(73) Assignee: Meco S.A., Grenchen (CH)

( * ) Notice: Subject to any disclaimer, the term of this patent is extended or adjusted under 35 U.S.C. 154(b) by 108 days.

(21) Appl. No.: 13/050,368

(22) Filed: Mar. 17, 2011

(65) Prior Publication Data

US 2011/0228646 A1 Sep. 22, 2011

(30) Foreign Application Priority Data

Mar. 17, 2010 (EP) ..... 10156794

(51) Int. Cl.
*G04B 37/00* (2006.01)

(52) U.S. Cl.
USPC ..... 368/319; 368/288; 368/308

(58) Field of Classification Search
USPC ..... 368/308, 319, 288, 306
See application file for complete search history.

(56) References Cited

U.S. PATENT DOCUMENTS

| | | | | | |
|---|---|---|---|---|---|
| 909,515 | A * | 1/1909 | Axtell | 368/288 |
| 951,672 | A * | 3/1910 | Axtell | 368/308 |
| 2,268,749 | A * | 1/1942 | Greenberg | 368/288 |
| 2,497,935 | A * | 2/1950 | Feurer | 368/288 |
| 2,637,987 | A * | 5/1953 | Hill et al. | 464/37 |
| 3,357,173 | A | 12/1967 | Wyssen | |
| 3,389,550 | A * | 6/1968 | Piquerez | 368/308 |
| 3,389,551 | A | 6/1968 | Wyssen | |
| 3,525,211 | A | 8/1970 | Wyssen | |
| 6,137,750 | A * | 10/2000 | Rieben | 368/290 |
| 7,384,190 | B2 | 6/2008 | Zimmermann | |
| 7,815,365 | B2 * | 10/2010 | Hiranuma et al. | 368/319 |
| 7,959,352 | B2 * | 6/2011 | Bonnet et al. | 368/319 |
| 8,142,070 | B2 * | 3/2012 | Bonnet et al. | 368/319 |
| 2008/0008053 | A1 | 1/2008 | Zimmermann | |
| 2009/0122656 | A1 | 5/2009 | Bonnet et al. | |
| 2009/0122657 | A1 | 5/2009 | Bonnet et al. | |

FOREIGN PATENT DOCUMENTS

| | | | |
|---|---|---|---|
| EP | 1 566 708 | A2 | 8/2005 |
| EP | 1 586 960 | A1 | 10/2005 |
| EP | 2 058 713 | A1 | 5/2009 |
| EP | 2 058 714 | A1 | 5/2009 |
| FR | 1 506 657 | | 12/1967 |
| FR | 1 571 565 | A | 6/1969 |
| WO | 2007/113723 | A2 | 10/2007 |

OTHER PUBLICATIONS

European Search Report issued in corresponding application No. EP10156794, completed Sep. 10, 2010.

* cited by examiner

*Primary Examiner* — Sean Kayes
(74) *Attorney, Agent, or Firm* — Griffin & Szipl, P.C.

(57) ABSTRACT

Winding crown for a timepiece, said crown (40) including a bottom (42) and a skirt (44), which delimits an inner volume housing at least one elastically deformable element, the crown (40) being characterized in that a stop member is inserted between the elastically deformable element (50) and the bottom (42) of the crown (40) to prevent any surface contact between said elastically deformable element (50) and said bottom (42).

3 Claims, 2 Drawing Sheets

WINDING CROWN FOR A TIMEPIECE

Figure 1:
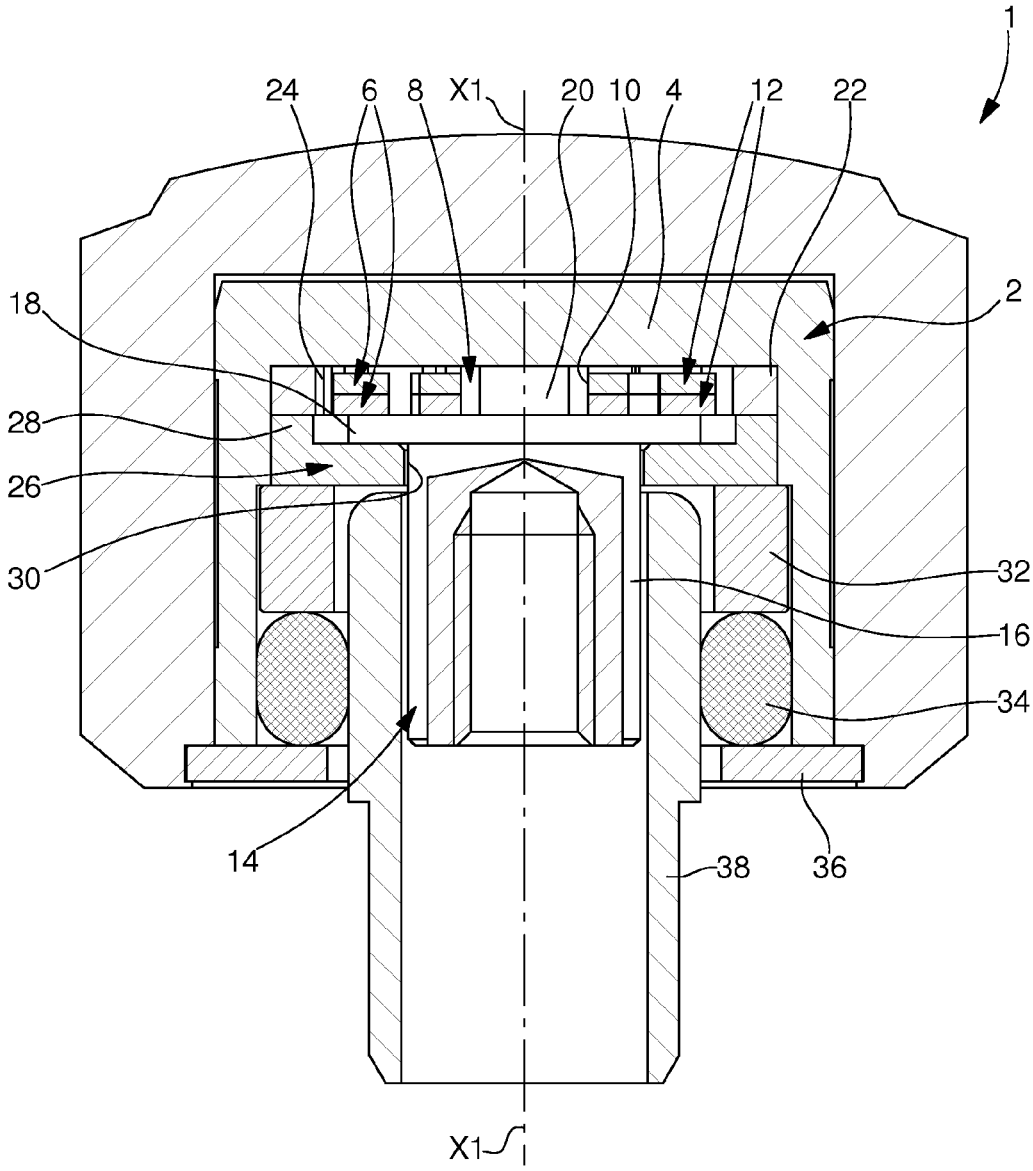

This application claims priority from European Patent Application No. 10156794.9 filed 17.03.2010, the entire disclosure of which is incorporated herein by reference.

The present invention concerns a winding crown for a timepiece. More specifically, the present invention concerns a crown of this type protected against any secondary or parasitic resisting torque.

A timepiece crown of the type mentioned in the preamble is known from EP Patent Application No. 1 586 960 in the name of the Applicant. This crown is shown in cross-section in FIG. 1 annexed hereto. Designated as a whole by the general reference number 1, this crown has an axis X1 of rotational symmetry and is hollow so as to define a recess which houses the various elements of the disconnecting mechanism. These elements include, in particular, a hollow support element 2 whose dimensions are fitted to those of the hollow inner recess of crown 1 and which is closed on one side by a bottom 4.

Next, there are two identical springs 6 intended to be arranged against the bottom 4 of hollow support element 2. Springs 6 are both flat type springs. Each spring includes a central base 8 the shape of which is generally close to a square and which is pierced by a hole 10, also substantially square-shaped, centred on the general axis of symmetry X1 of crown 1. Four elastically deformable arms 12 extend from central base 8 of each of the two springs 6.

The assembly is completed by a generally cylindrical pipe 14, a first end of which, pointing towards the centre of the timepiece movement, is for receiving a winding stem (not shown). Pipe 14 includes a cylindrical main part 16 on which there is mounted a disc-shaped head 18, whose diameter is larger than the diameter of main part 16. On head 18 there is mounted a portion 20, whose transverse dimensions are smaller than those of main part 16 and which projects from the surface of head 18. This projecting portion 20 is centred on axis of symmetry X1 of crown 1 and has a complementary square-shaped contour to that of holes 10 of springs 6 with which projecting portion 20 is intended to cooperate.

The assembly is continued by a rigid element 22 in the form of a ring or washer whose central opening has a larger diameter than the diameter of head 18 of pipe 14. This rigid ring 22 has a plurality of notches 24 intended to cooperate with the elastic arms 12 of springs 6. It is arranged against bottom 4 of hollow element 2 such that notches 24 are facing arms 12 of springs 6.

An additional washer 26 is provided to support rigid ring 22 and pipe 14. For this purpose, washer 26 has an annular shoulder 28 of larger inner diameter than the diameter of head 18 of pipe 14 and a substantially equal external diameter to the diameter of rigid ring 22. The height of annular shoulder 28 of washer 26 is selected such that it is equal to or greater than the thickness of head 18 of pipe 14, which enables shoulder 18 to play the part of a spacer or strut. Washer 26 further includes a central opening 30 whose diameter is adjusted to the diameter of the main part 16 of pipe 14.

The sole object of the remaining elements is to close crown 1 so as to ensure sealing and they play no part in the disconnecting mechanism described above. Thus, the following elements are mounted one after the other: a reduction washer 32, whose external diameter is substantially equal to the inner diameter of support element 2 and an annular O-ring joint 34, whose external diameter at rest is substantially larger than the inner diameter of support element 2. A flat washer 36 is then provided to close the inner recess of crown 1.

Finally, a tube 38 is passed through flat washer 36, sealing gasket 34 and reduction washer 32 and secured to the main part 16 of pipe 14. The function of this tube 38, whose external diameter is substantially larger than the inner diameter of O-ring joint 34, is to enable crown 1 to be mounted on the middle part of a watch case.

On the external surface thereof, crown 1 has a plurality of grooves for facilitating the handling of crown 1 by the user. As will have been clear from the foregoing, crown 1 delimits a hollow inner recess which houses the disconnecting mechanism. This disconnecting mechanism essentially includes a rigid ring 22, including, on the periphery thereof, a plurality of notches 24 intended to cooperate with one or several generally circular spring elements 6 to perform the disconnecting function. Notched ring 22 is integral with crown 1, whereas spring elements 6 are secured to pipe 14 onto which a winding stem, which acts on the winding mechanism for the mainspring, is screwed. Provided the resisting torque supplied by spring elements 6 is less than a predetermined value, said elements are driven in rotation by rigid ring 22, as a result of activation of crown 1 by the user. In turn, spring elements 6 drive pipe 14, on which they are mounted, and thus the winding stem. When the resisting torque supplied by spring elements 6 becomes greater than the predetermined value because the mainspring is completely wound, said spring elements 6 will deform elastically in response to actuation of rigid ring 22 and will slide away therefrom. As a result, crown 1 will rotate uselessly when actuated by the user. The mainspring is therefore protected against any excessive winding which could damage it.

The top end of pipe 14 has a projecting, for example square-shaped, portion 20 which enters a square hole, made in springs 6 and via which said springs 6 are secured to said pipe 14. Thus, when a movement of rotation is imparted to springs 6, the latter in turn drive pipe 14 in rotation via projecting portion 20 thereof.

During use, the crown described above has raised a problem. Indeed, as can be understood upon examining FIG. 1, when pressure is exerted on crown 1, there is nothing to prevent the uppermost spring element in the pile of spring elements 6 from abutting against the bottom 4 of support element 2. This surface contact between spring element 6 and bottom 4 of support element 2 generates a secondary or parasitic torque which delays the moment at which the resisting torque provided by spring elements 6 becomes greater than the predetermined threshold value and at which said spring elements 6 will deform elastically in response to actuation of rigid ring 22 and slide away therefrom In other words, disconnection may occur after the mainspring has been completely wound, thereby creating a serious risk of damaging the watch movement.

It is also possible to envisage the case of a crown, the internal volume of which houses a helical spring element abutting against the bottom of the crown. When this crown is pressed and rotated, the contacts between the spring element and the bottom of the crown generate friction forces which may be felt by the user, giving him the impression of a poor quality mechanism.

It is an object of the present invention to overcome these problems by providing a winding crown which is not subject to any secondary friction and which protects the timepiece movement and in particular the mainspring.

The present invention therefore concerns a winding crown for a timepiece, said crown including a bottom and a skirt that delimits an inner volume, which houses at least one elastically deformable element, the crown being characterized in that a stop member is inserted between the elastically deformable element and the bottom of the crown to prevent any surface contact between the elastically deformable element and said bottom.

Owing to these features, the present invention provides a winding crown for a timepiece in which a stop member is inserted between the bottom of the crown and the elastically deformable element. This stop member prevents the elastically deformable element from coming into contact with the surface of the bottom of the crown when the crown is pressed axially in the direction of the centre of the timepiece movement. Any secondary torque is thus avoided, thereby providing a winding crown with improved operation and efficiently protecting the timepiece movement, particularly the mainspring.

It will be clear that the contact surface between the stop member and the bottom of the crown is smaller than the contact surface between the elastically deformable element and said bottom, so that the secondary torque caused by the stop member is substantially less than the secondary torque caused by the elastic element.

According to a complementary feature of the invention, the stop member is formed by stud with a head, partially housed inside a recess made in the bottom of the crown and projecting from the recess at a height that defines the space between the spring and the bottom of the crown.

According to another feature of the invention, the stud head is conical. The conical shape of the stud head also contributes to reducing the contact surface between the stud and the bottom of the crown and consequently to limiting the friction forces between these two parts.

Figure 2:
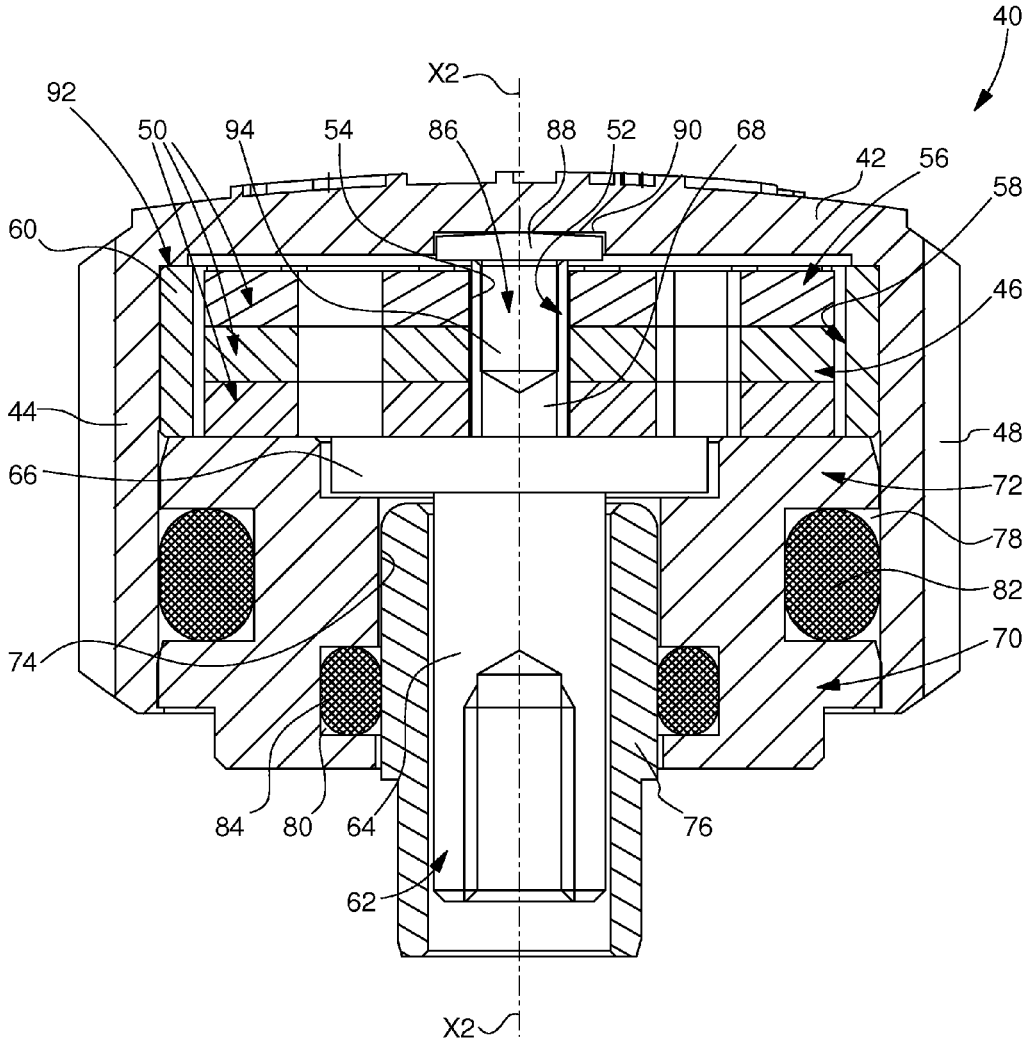

Other features and advantages of the present invention will appear more clearly in the following detailed description of an embodiment of the winding crown for a timepiece according to the invention, this example being given purely by way of non-limiting illustration with reference to the annexed drawing, in which:

FIG. 1, already cited, is a cross-section of a winding crown for a timepiece according to the prior art, and FIG. 2 is a cross-section of a winding crown for a timepiece according to the invention.

The present invention proceeds from the general inventive idea which consists, in a disconnecting mechanism for a timepiece winding crown, in inserting a block between the elastically deformable element and the bottom of the crown to prevent any surface contact between these two elements. Consequently, any secondary torque is prevented when the crown is pressed axially in the direction of the centre of the watch movement, which means that the moment at which the elastically deformable element escapes from the rigid drive ring does not have to be altered to protect the watch movement and in particular the mainspring.

Designated as a whole by the general reference 40, the winding crown according to the invention has a very similar structure to that described above with reference to FIG. 1. For a complete description of this crown, reference may usefully be made to EP Patent Application No. 1 586 960 in the name of the Applicant which is incorporated herein by reference. The winding crown 40 according to the invention is centred on an axis of rotational symmetry X2 and includes a bottom 42 and a skirt 44, which delimits an inner volume housing a disconnection mechanism 46. The external peripheral surface of this skirt 44 has grooves 48 for facilitating handling of crown 40 by the user.

Next, there are three identical superposed springs 50, intended to be arranged on the bottom 42 side of crown 40. These springs 50 are flat type springs. Three identical springs are provided rather than a single spring with the same thickness as the sum of the thicknesses of the three superposed springs, since it is easier to machine and control the elastic properties of a spring of smaller thickness.

As in the example described above with reference to FIG. 1, each of the three springs 50 includes a central base 52 whose shape is generally close to that of a square and which is pierced with a substantially square hole 54 centred on the general axis of symmetry X2 of crown 40. Four elastically deformable arms 56 extend from the central base 52 of each of the three springs 50. These arms 56 are intended to cooperate with the notches 58 of a rigid ring-shaped element 60 whose external diameter is adjusted to the inner diameter of the volume delimited by skirt 44. Rigid ring 60 is arranged against the bottom 42 of crown 40 such that notches 58 are facing arms 56 of springs 50.

The assembly is completed by a generally cylindrical pipe 62, a first end of which, pointing towards the centre of the timepiece movement, is intended to receive a winding stem (not shown). Pipe 62 includes a cylindrical main part 64 on which a disc-shaped head 66 is mounted, the diameter of which is greater than the diameter of main part 64. A portion 68, whose transverse dimensions are smaller than that of main part 64 and which projects from the surface of head 66, is mounted on said head 66. This projecting portion 68 is centred on the axis of symmetry X2 of crown 40 and has a complementary square contour to that of holes 54 in springs 50 with which this projecting portion 68 is intended to cooperate. For this purpose, projecting portion 68 is slightly higher than the thickness of the three springs 50 together.

A bush 70 is provided to support notched ring 60 and pipe 62. Thus, bush 70 has an annular shoulder 72 of smaller inner diameter than the diameter of head 66 of pipe 62 and an external diameter substantially equal to the diameter of notched ring 60. The height of annular shoulder 72 of bush 70 is selected such that it is equal to or greater than the thickness of head 66 of pipe 62, which allows shoulder 28 to play the part of a spacer or strut. Bush 70 further includes a central opening 74, whose diameter is adjusted to the diameter of a tube 76 secured to main part 64 of pipe 62 and the function of which is to allow crown 40 to be mounted on the middle part of a watch case.

Finally, first and second circular grooves 78 and 80 are made in bush 70 and each receives an O-ring joint 82 and 84 respectively. The first joint 82 ensures the seal between skirt 44 of crown 40 and bush 70, and the second joint 84 ensure the seal between bush 70 and tube 76.

According to the invention, between bottom 42 of crown 40 and the uppermost spring in the pile of three springs 50, a stud 86 is inserted, which plays the part of a shim or stop member for preventing spring 50 from coming into contact with bottom 42 of crown 40. Thus, stud 86 has a head 88 partially housed inside a recess 90 made in bottom 42 of crown 40 and whose diameter is greater than the dimensions of hole 54 in spring 50. The head 88 of stud 86 projects from recess 90 at a height lower than or equal to the height of a shoulder 92 against which notched ring 60 abuts. Head 88 of stud 86 is extended by a foot 94, which is freely guided in projecting portion 68 mounted on head 66 of pipe 62. It will be clear that the contact surface between head 88 of stud 86 and bottom 42 of crown 40 is smaller than the contact surface between spring 56 and bottom 42, such that the secondary torque caused by stud 86 is substantially less than the secondary torque caused by spring 56. Moreover, the conical shape of head 88 of stud 86 also contributes to reducing the contact surface between stud 88 and bottom 42 of crown 40 and consequently to limiting the friction forces between these two parts.

It goes without saying that this invention is not limited to the embodiment that has just been described and that various simple alterations and variants may be envisaged by those skilled in the art without departing from the scope of the invention as defined by the annexed claims. In particular, it will be noted that in the embodiments described in EP Patent Application Nos. 2 058 713 and 2 058 714 in the name of the Applicant, the uppermost spring in the pile of springs is abutting along an annular surface against a shoulder provided in the inner volume of the crown. This abutment along a restricted annular surface does not generate torque liable to disturb the operation of the disconnection mechanism housed in the crown in any significant way. It is also possible to envisage the case of a crown whose inner volume houses a helical spring element abutting against the bottom of the crown. When this crown is pressed and rotated, the contacts between the spring element and the bottom of the crown generate friction forces which may be felt by the user and give him the impression of a poor quality mechanism.

What is claimed is:

1. A winding crown for a timepiece, the winding crown comprising:

(a) a bottom; and (b) a skirt, wherein the skirt delimits an inner volume housing at least one elastically deformable element, wherein a stop member is inserted between the elastically deformable element and the bottom of the winding crown to prevent any surface contact between the elastically deformable element and the bottom, wherein the stop member is formed by a stud including a head partially housed inside a recess made in the bottom of the winding crown and projecting from the recess at a height that defines the space between the elastic element and the bottom of the crown.

2. The winding crown according to claim 1, wherein the head of the stud is conical.

3. A winding crown for a timepiece, the winding crown comprising:

(a) a bottom;

(b) a skirt, wherein the skirt delimits an inner volume housing at least one elastically deformable element, wherein a stop member is inserted between the elastically deformable element and the bottom of the winding crown to prevent any surface contact between the elastically deformable element and the bottom;

(c) a disconnecting mechanism including a rigid drive ring integral with the winding crown and cooperating with the elastically deformable element; and (d) a pipe with a first end that points towards the centre of the timepiece movement, wherein the elastic element is integral with the pipe, and wherein the pipe receives a winding stem, wherein the rigid ring drives the elastically deformable element in at least one direction of rotation until a resisting torque provided by the elastic element exceeds a threshold value beyond which the elastic element deforms so as to interrupt the drive connection with the rigid ring, and wherein the elastically deformable element has, for this purpose, means for temporary coupling to the rigid drive ring, wherein the stop member is formed by a stud including a head partially housed inside a recess made in the bottom of the winding crown and projecting from the recess at a height that defines the space between the elastic element and the bottom of the crown, and wherein the head of the stud is conical.

* * * * *